US008147040B2

(12) United States Patent
Menzel et al.

(10) Patent No.: US 8,147,040 B2
(45) Date of Patent: Apr. 3, 2012

(54) MOISTURE PROTECTION OF FLUID EJECTOR

(75) Inventors: Christoph Menzel, New London, NH (US); Paul A. Hoisington, Hanover, NH (US); Michael Ducker, Washington, NH (US); Kevin Von Essen, San Jose, CA (US); Andreas Bibl, Los Altos, CA (US)

(73) Assignee: FUJIFILM Corporation (JP)

( * ) Notice: Subject to any disclaimer, the term of this patent is extended or adjusted under 35 U.S.C. 154(b) by 185 days.

(21) Appl. No.: 12/395,583

(22) Filed: Feb. 27, 2009

(65) Prior Publication Data

US 2010/0220146 A1 Sep. 2, 2010

(51) Int. Cl.
*B41J 2/045* (2006.01)
*B41J 2/14* (2006.01)

(52) U.S. Cl. ..... 347/70; 347/50; 347/68

(58) Field of Classification Search ..... 347/68–72, 347/50

See application file for complete search history.

(56) References Cited

U.S. PATENT DOCUMENTS

| | | | | |
|---|---|---|---|---|
| 4,734,721 | A | 3/1988 | Boyer et al. | |
| 5,489,932 | A | 2/1996 | Ceschin et al. | |
| 6,231,174 | B1 | 5/2001 | Haigo | |
| 6,544,902 | B1 * | 4/2003 | Farnworth | 438/781 |
| 6,994,422 | B2 | 2/2006 | Park et al. | |
| 7,128,406 | B2 | 10/2006 | Dixon et al. | |
| 7,156,481 | B2 | 1/2007 | Matsuba et al. | |
| 7,338,143 | B2 | 3/2008 | Onishi et al. | |
| 2003/0234834 | A1 * | 12/2003 | Nakano et al. | 347/68 |
| 2005/0248232 | A1 * | 11/2005 | Itaya et al. | 310/320 |

FOREIGN PATENT DOCUMENTS

JP 04-349675 12/1992

OTHER PUBLICATIONS

International Search Report and Written Opinion for International Application No. PCT/US2010/025548, mailed May 3, 2010, 13 pages.

EMD-4000 General Eastern Humidity Sensor, General Electric (2004). Retrieved from the Internet: www.gesensing.com, 4 pages.

STAYDRY™, HiCap2000—High Capacity Moisture Getter. Cookson Electronics (2007). Retrieved from the Internet: www.cooksonsemi.com, 4 pages.

* cited by examiner

*Primary Examiner* — Geoffrey Mruk
(74) *Attorney, Agent, or Firm* — Fish & Richardson P.C.

(57) ABSTRACT

A fluid ejection apparatus includes a substrate having a plurality of fluid passages for fluid flow and a plurality of nozzles fluidically connected to the fluid passages, a plurality of actuators positioned on top of the substrate to cause fluid in the plurality of fluid passages to be ejected from the plurality of nozzles, a protective layer formed over at least a portion of the plurality of actuators, a housing component having a chamber, the chamber adjacent to the substrate, and an absorbent layer inside the cavity. The absorbent layer is more absorptive than the protective layer.

31 Claims, 5 Drawing Sheets

MOISTURE PROTECTION OF FLUID EJECTOR

TECHNICAL FIELD

The present disclosure relates generally to fluid droplet ejection.

BACKGROUND

In some implementations of a fluid droplet ejection device, a substrate, such as a silicon substrate, includes a fluid pumping chamber, a descender, and a nozzle formed therein. Fluid droplets can be ejected from the nozzle onto a medium, such as in a printing operation. The nozzle is fluidly connected to the descender, which is fluidly connected to the fluid pumping chamber. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device. The ejection of a fluid droplet from a nozzle can be timed with the movement of the medium to place a fluid droplet at a desired location on the medium. Fluid ejection devices typically include multiple nozzles, and it is usually desirable to eject fluid droplets of uniform size and speed, and in the same direction, to provide uniform deposition of fluid droplets on the medium.

SUMMARY

In general, in one aspect a fluid ejection apparatus includes a substrate having a plurality of fluid passages for fluid flow and a plurality of nozzles fluidically connected to the fluid passages, a plurality of actuators positioned on top of the substrate to cause fluid in the plurality of fluid passages to be ejected from the plurality of nozzles, a protective layer formed over at least a portion of the plurality of actuators, a housing component having a chamber, the chamber adjacent to the substrate, and an absorbent layer inside the cavity. The absorbent layer is more absorptive than the protective layer.

This and other embodiments can optionally include one or more of the following features. The actuators can be piezoelectric actuators. The actuators can be inside the chamber. The fluid ejection apparatus can further include a plurality of integrated circuit elements, the integrated circuit elements being inside the chamber. The housing component can be an interposer. The absorbent layer can be attached to a bottom surface of the housing component. The absorbent layer can have a length and a width that is approximately equal to a length and a width of the chamber. The protective layer can include SU-8. The absorbent layer can include a desiccant. The desiccant can be desiccant is chosen from a group consisting of silica gel, calcium sulfate, calcium chloride, montmorillonite clay, molecular sieves, zeolite, alumina, calcium bromide, lithium chloride, alkaline earth oxide, potassium carbonate, copper sulfate, zinc chloride, and zinc bromide. The absorbent layer can be paper, plastic, or organic material. The plastic can be nylon6, nylon66, or cellulose acetate. The organic material can be starch or polyamide. The interposer can include at least one fluid supply passage having an opening on a bottom surface of the interposer, and the plurality of of fluid passages can include at least one inlet on the top surface of the substrate, wherein a portion of the bottom surface of the interposer around the opening abuts a portion of the top surface of the substrate around the opening to fluidically connect the fluid supply passage to the inlet, and wherein an interface between the interposer and the substrate around the fluid supply passage and the inlet is at least partially sealed. The absorbent layer can not contact the actuators.

In general, in one aspect, a fluid ejector includes a module including a substrate having a plurality of fluid paths and a plurality of actuators, each actuator configured to cause a fluid to be ejected from a nozzle of an associated fluid path, a plurality of actuators, each actuator configured to cause a fluid to be ejected from a nozzle of an associated fluid path, a plurality of integrated circuit elements, wherein the plurality of integrated circuit elements are mounted on the fluid ejection module, and a housing positioned to form a cavity above the fluid ejection module. The housing has a channel, and the channel connects the cavity with a chamber, the chamber including an absorbent material.

This and other embodiments can optionally include one or more of the following features. The plurality of integrated circuits can be in the cavity. The plurality of actuators can be in the cavity. The absorbent material can comprise a desiccant. The desiccant can be chosen from a group consisting of desiccant is chosen from a group consisting of silica gel, calcium sulfate, calcium chloride, montmorillonite clay, molecular sieves, zeolite, alumina, calcium bromide, lithium chloride, alkaline earth oxide, potassium carbonate, copper sulfate, zinc chloride, and zinc bromide. The absorbent layer can be paper, plastic, or organic material. The plastic can be nylon6, nylon66, or cellulose acetate. The organic material can be starch or polyamide. A flexible circuit element can be in electrical communication with the fluid ejection module, and a chamber can be attached to the flexible circuit element.

In general, in one aspect, a fluid ejector can include a fluid ejection module including a substrate having a plurality of fluid paths and a plurality of actuators, each actuator configured to cause a fluid to be ejected from a nozzle of an associated fluid path, a plurality of integrated circuit elements, wherein the plurality of integrated circuit elements are mounted on the fluid ejection module, and a housing positioned to form a cavity above the integrated circuit elements. The housing has a channel, and the channel connects the cavity with a pump, the pump configured to be activated by a humidity sensor.

In general, in one aspect, a fluid ejector can include a fluid ejection module including a substrate having a plurality of fluid paths and a plurality of actuators, each actuator configured to cause a fluid to be ejected from a nozzle of an associated fluid path, a plurality of integrated circuit elements, wherein the plurality of integrated circuit elements are mounted on the fluid ejection module, and a housing positioned to form a cavity above the integrated circuit elements. The housing has a channel, and the channel connects the cavity with the atmosphere.

By including an absorbent layer inside a chamber, the chamber adjacent to the substrate, moisture from the fluid ejector can be absorbed to avoid degradation, e.g., shorting, of the actuators or integrated circuit elements on the substrate. Further, by having a channel inside the housing that connects to a chamber having an absorbent material or to a pump activated by a humidity sensor, moisture can be vented away from the integrated circuit elements to avoid shorting of the integrated circuit elements. Removing moisture from the actuators and the integrated circuit elements can help extend the lifetime of a fluid ejector.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

One problem with fluid droplet ejection from a fluid ejector is that moisture from the fluid can intrude into the electrical or actuating components, such as the electrodes or piezoelectric material of a piezoelectric actuator or an integrated circuit elements driving the piezoelectric actuator. Moisture can cause failure of the fluid ejector due to electrical shorting or degradation of the piezoelectric material, and can reduce the lifetime of the fluid ejector. By including an absorbent layer near the actuators, moisture can be absorbed to avoid degradation of the piezoelectric material or shorting of electrodes of the actuators or integrated circuit elements. Further, by having a passage in the housing of a fluid ejector that leads from a cavity near the integrated circuit elements to a chamber having an absorbent material, to a pump activated by a humidity sensor, or to atmosphere, moisture can be vented away from the integrated circuit elements to avoid shorting.

Figure 1:
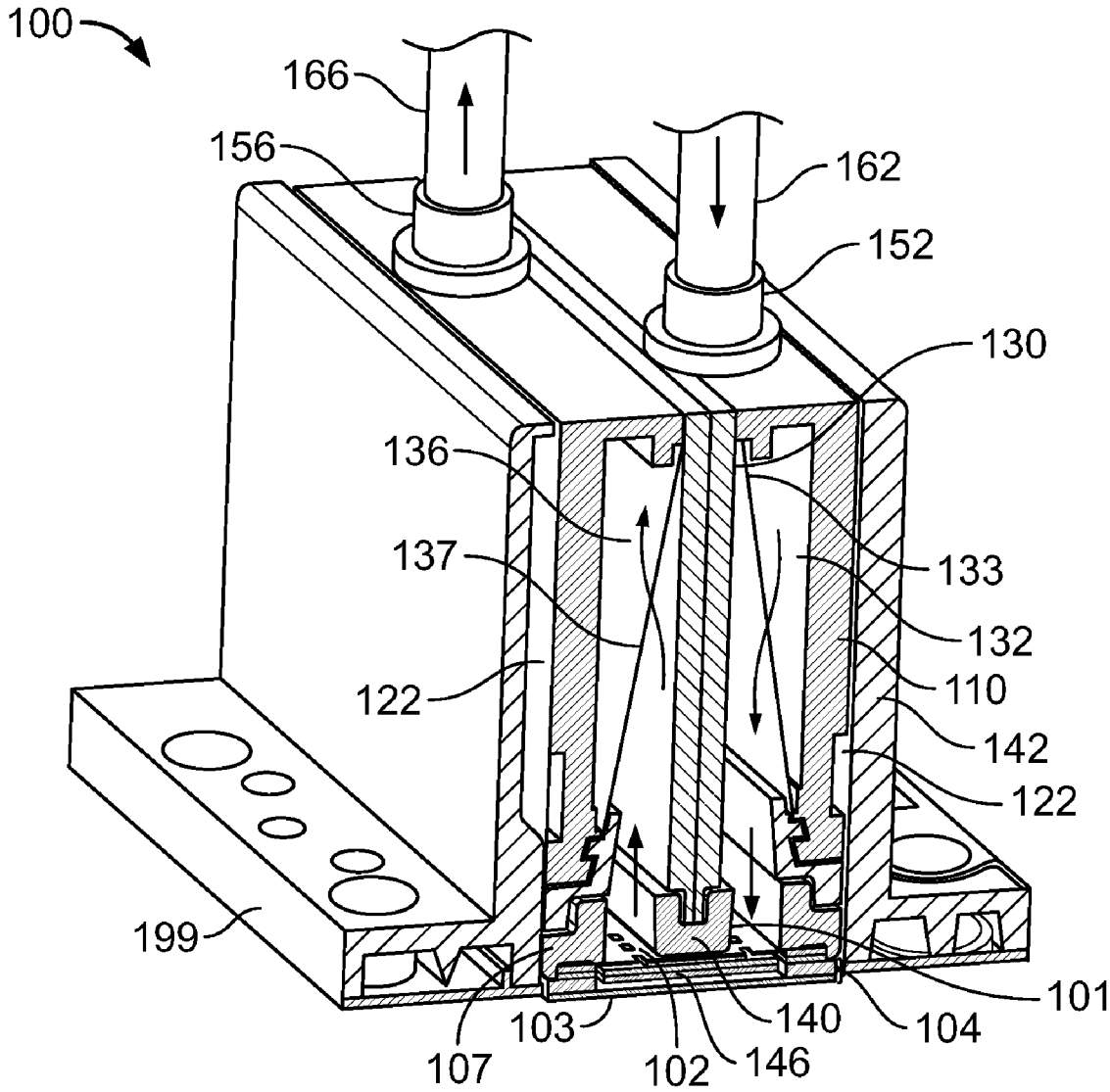
FIG. 1 is a perspective view of an example fluid ejector.

Referring to FIG. 1, an implementation of a fluid ejector 100 includes a fluid ejection module, e.g. a quadrilateral plate-shaped printhead module, which can be a die fabricated using semiconductor processing techniques. The fluid ejection module includes a substrate 103 in which a plurality of fluid paths 124 (see FIGS. 2A, 2B) are formed, and a plurality of actuators to individually control ejection of fluid from nozzles of the flow paths.

The fluid ejector 100 can also include an inner housing 110 and an outer housing 142 to support the printhead module, a mounting frame 199 to connect the inner housing 110 and outer housing 142 to a print bar, and a flexible circuit, or flex circuit 201 (see FIG. 2A) and associated printed circuit board 155 (see FIG. 4C) to receive data from an external processor and provide drive signals to the die. The outer housing 142 can be attached to the inner housing 110 such that a cavity 122 is created between the two. The inner housing 110 can be divided by a dividing wall 130 to provide an inlet chamber 132 and an outlet chamber 136. Each chamber 132 and 136 can include a filter 133 and 137. Tubing 162 and 166 that carries the fluid can be connected to the chambers 132 and 136, respectively, through apertures 152, 156. The dividing wall 130 can be held by a support 144 that sits on an interposer assembly 146 above the substrate 103. The inner housing 110 can further include a die cap 107 configured to seal a cavity 901 (see FIG. 2A) in the fluid ejector 100 and to provide a bonding area for components of the fluid ejector that are used in conjunction with the substrate 103. The fluid ejector 100 further includes fluid inlets 101 and fluid outlets 102 for allowing fluid to circulate from the inlet chamber 132, through the substrate 103, and into the outlet chamber 136.

Figure 2A:
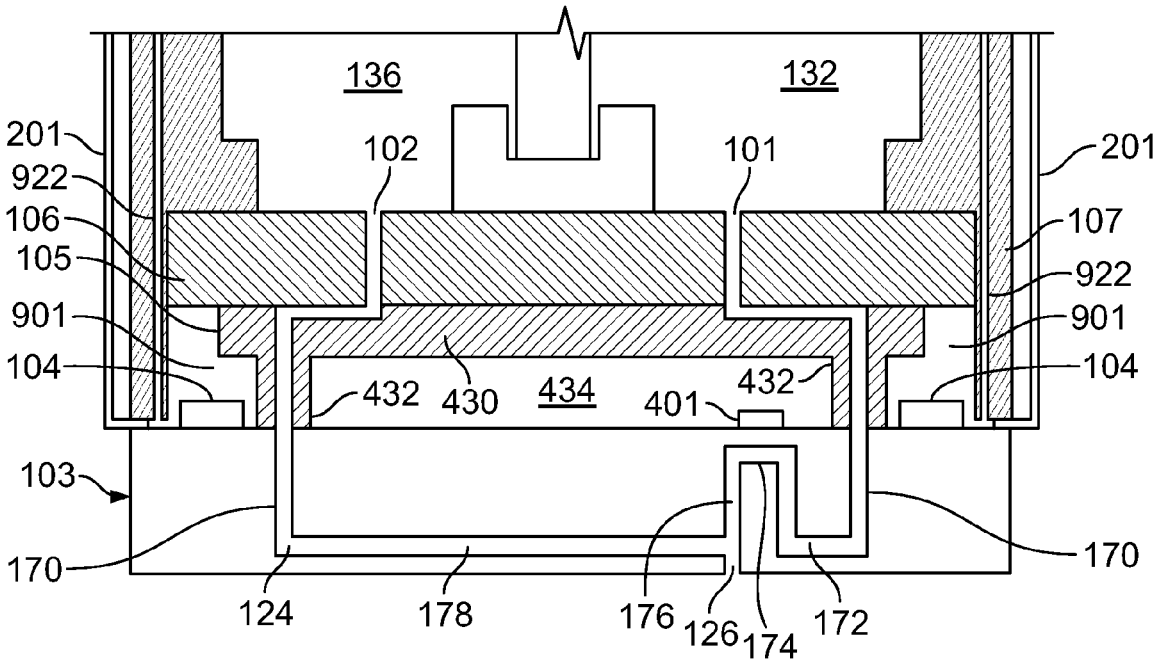
FIG. 2A is a cross-sectional schematic of a portion of an example fluid ejector.

Referring to FIG. 2A, the substrate 103 can include fluid flow paths 124 that end in nozzles 126 (only one flow path is shown in FIG. 2A). A single fluid path 124 includes a fluid feed 170, an ascender 172, a pumping chamber 174, and a descender 176 that ends in the nozzle 126. The fluid path can further include a recirculation path 178 so that ink can flow through the ink flow path 124 even when fluid is not being ejected.

Figure 2B:
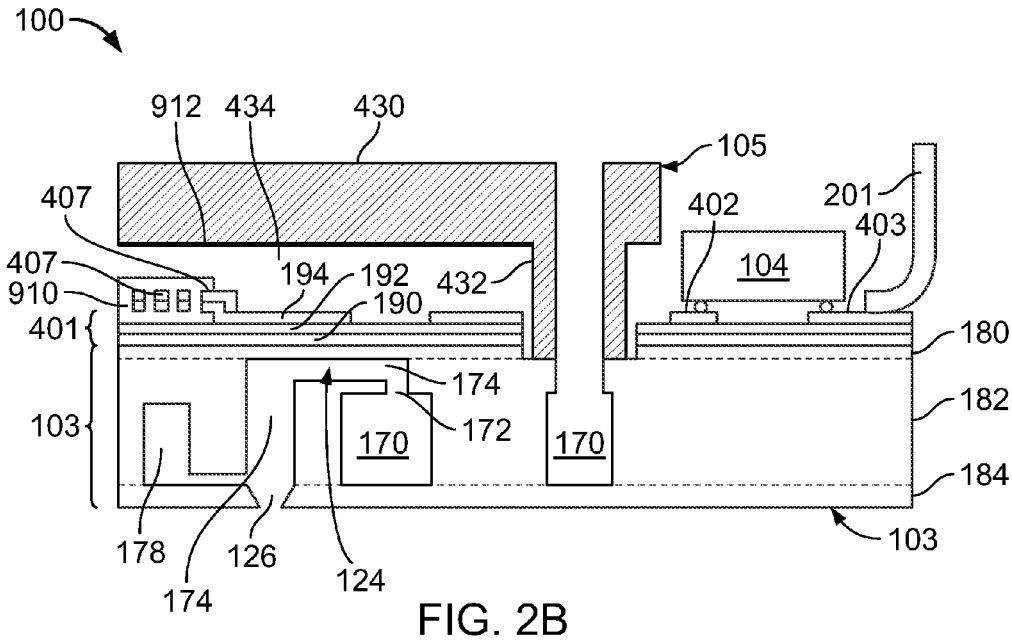
FIG. 2B is a close-up view of a portion of the fluid ejector of FIG. 2A.

Shown in FIG. 2B, the substrate 103 can include a flow-path body 182 in which the flow path 124 is formed by semiconductor processing techniques, e.g., etching. Substrate 103 can further include a membrane 180, such as a layer of silicon, which seals one side of the pumping chamber 174, and a nozzle layer 184 through which the nozzle 126 is formed. The membrane 180, flow path body 182 and nozzle layer 184 can each be composed of a semiconductor material (e.g., single crystal silicon).

Referring to FIGS. 2A and 2B, the fluid ejector 100 can also include individually controllable actuators 401 supported on the substrate 103 for causing fluid to be selectively ejected from the nozzles 126 of corresponding fluid paths 124 (only one actuator 401 is shown in FIGS. 2A, 2B). In some embodiments, activation of the actuator 401 causes the membrane 180 to deflect into the pumping chamber 174, forcing fluid through the descender 174 and out of the nozzle 126. For example, the actuator 401 can be a piezoelectric actuator, and can include a lower conductive layer 190, a piezoelectric layer 192, e.g., formed of lead zirconate titanate (PZT), and a patterned upper conductive layer 194. The piezoelectric layer 192 can be between e.g. about 1 and 25 microns thick, e.g., about 2 to 4 microns thick. Alternatively, the actuator 401 can be a thermal actuator. Each actuator 401 has several corresponding electrical components, including an input pad and one or more conductive traces 407 to carry a drive signal. Although not shown in FIG. 2B, the actuators 401 can be disposed in columns in a region between the inlets 101 and outlets 102. Each flow path 124 with its associated actuator 401 provides an individually controllable MEMS fluid ejector unit.

Figure 3:
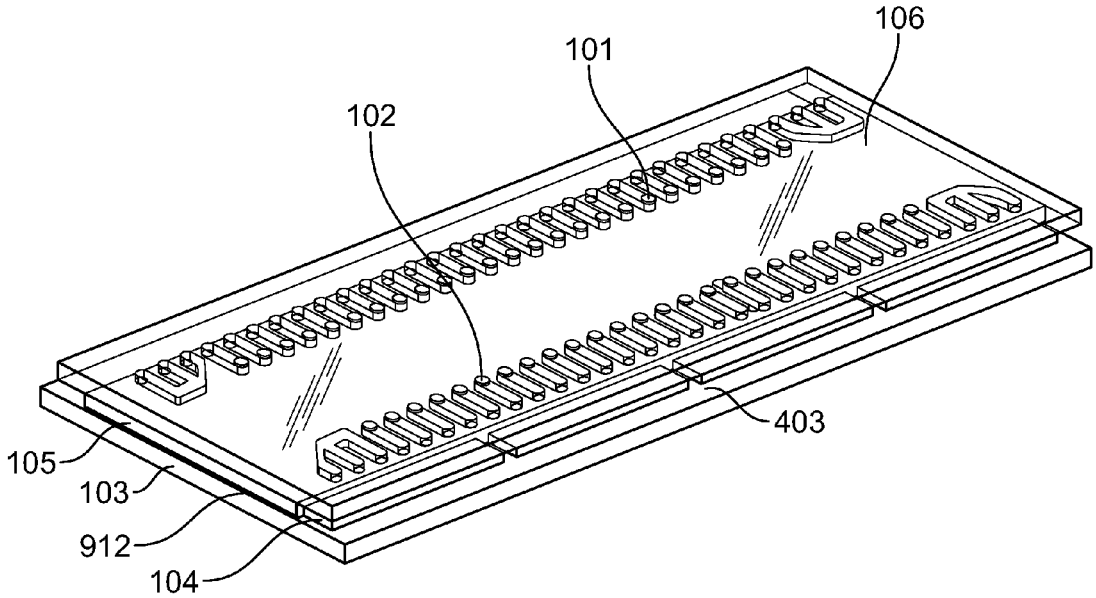
FIG. 3 is a schematic semi-transparent perspective view of an example substrate with an upper and lower interposer.

Referring to FIGS. 2B and 3, the fluid ejector 100 further includes one or more integrated circuit elements 104 configured to provide electrical signals, e.g., on the conductive traces 407, to control actuators 401. The integrated circuit element 104 can be a microchip, other than the substrate 103, in which integrated circuits are formed, e.g., by semiconductor fabrication and packaging techniques. For example, the integrated circuit elements 104 can be application-specific integrated circuit (ASIC) elements. Each integrated circuit element 104 can include corresponding electrical components, such as the input pad 402, output trace 403, transistors, and other pads and traces. The integrated circuit elements 104 can be mounted directly onto the substrate 103 in a row extending parallel to the inlets 101 or outlets 102.

Referring to FIGS. 2A, 2B, and 3, in some embodiments, the inner housing 110 includes a lower interposer 105 to separate the fluid from the electrical components actuators 401 and/or the integrated circuit elements 104. As shown in FIG. 2A, the lower interposer 105 can include a main body 430 and flanges 432 that project down from the main body 430 to contact the substrate 103 in a region between the integrated circuit elements 104 and the actuators 401. The flanges 432 hold the main body 430 over the substrate to form an actuator cavity 434. This prevents the main body 430 from contacting and interfering with motion of the actuators 401. Although not shown, the cavity 434 with the actuators can be connected to the cavity 901 with the ASICs 104. For example, flanges 432 can extend only around fluid feed channels 170, e.g. in a donut shape, such that cavities 434 and 901 form one cavity, and air can pass between adjacent flanges.

In some implementations (shown in FIG. 2B), an aperture is formed through the membrane layer 180, as well as the layers of the actuator 401 if present, so that the flange 432 directly contacts the flow-path body 182. Alternatively, the flange 432 could contact the membrane 180 or another layer that covers the substrate 103. The fluid ejector 100 can further include an upper interposer 106 to further separate the fluid from the actuators 401 or integrated circuit elements 104.

In some embodiments, the lower interposer 105 directly contacts, with or without a bonding layer therebetween, the substrate 103, and the upper interposer 106 directly contacts, with or without a bonding layer therebetween, the lower interposer 105. Thus, the lower interposer 105 is sandwiched between the substrate 103 and the upper interposer 106, while maintaining the cavity 434. The flex circuits 201 (see FIG. 2A) are bonded to a periphery of the substrate 103 on a top surface of the substrate 103. The die cap 107 can be bonded to a portion of the flex circuit 201 that is bonded to the substrate 103, creating the cavity 901. The flex circuit 201 can bend around the bottom of the die cap 107 and extend along an exterior of the die cap 107. The integrated circuit elements 104 are bonded to an upper surface of the substrate 103, closer to a central axis of the substrate 103, such as a central axis that runs a length of the substrate 103, than the flex circuits 201, but closer to a perimeter of the substrate 103 than the lower interposer 105. In some embodiments, the side surfaces of the lower interposer 105 are adjacent to the integrated circuit element 104 and extend perpendicular to a top surface of the substrate 103.

In some embodiments, shown in FIG. 2B, a protective layer 910 is deposited on the fluid ejector module. The protective layer can include photoresist layer, such as a layer of SU-8, can be formed over the traces 407 of actuators 401 in order to protect the electrical components from fluid or moisture in the fluid ejector. The protective layer can be absent from the region above the pumping chamber 174, or the protective layer 901 can be formed over the traces 407 and the actuators 401, including over the pumping chamber 174. Alternatively or in addition, the protective layer 910 can include a non-wetting coating, such as a molecular aggregation, and can be formed over the traces 407 and the actuators 401.

Further, as shown in FIGS. 2B and 3, a moisture-absorbent layer 912 can be located inside the cavity 434. Alternatively, or in addition, the absorbent layer 912 can be located inside the cavity 901. The absorbent layer 912 can be more absorptive than the protective layer 910. The absorbent layer can be made of, for example, a desiccant. The desiccant can be, for example, silica gel, calcium sulfate, calcium chloride, montmorillonite clay, molecular sieves, zeolite, alumina, calcium bromide, lithium chloride, alkaline earth oxide, potassium carbonate, copper sulfate, zinc chloride, or zinc bromide. The desiccant can be mixed with another material, such as an adhesive, to form the absorbent layer 912, e.g. the absorbent can be STAYDRAY™ HiCap2000. Alternatively, an absorbent material such as paper, plastics (e.g. nylon6, nylon66, or cellulose acetate), organic materials (e.g. starch or polyimide such as Kapton® polyimide), or a combination of absorbent materials (e.g. laminate paper) can be placed in the cavity 122. The absorbent layer can also be made of other absorptive materials, such as paper, plastics (e.g. nylon6, nylon66, or cellulose acetate), organic materials (e.g. starch or polyamide), or a combination of absorbent materials (e.g. laminate paper). The absorbent layer 912 can be less than 10 microns, for example between 2 and 8 microns, thick to avoid interference with the proper functioning of the actuators 401. Further, the absorbent layer 912 can span most or all of the length and width of the cavity 434 in order to increase surface area and total absorbency. The absorbent layer 912 can be attached to, e.g., deposited on, a bottom surface of the interposer 104.

Figure 4A:
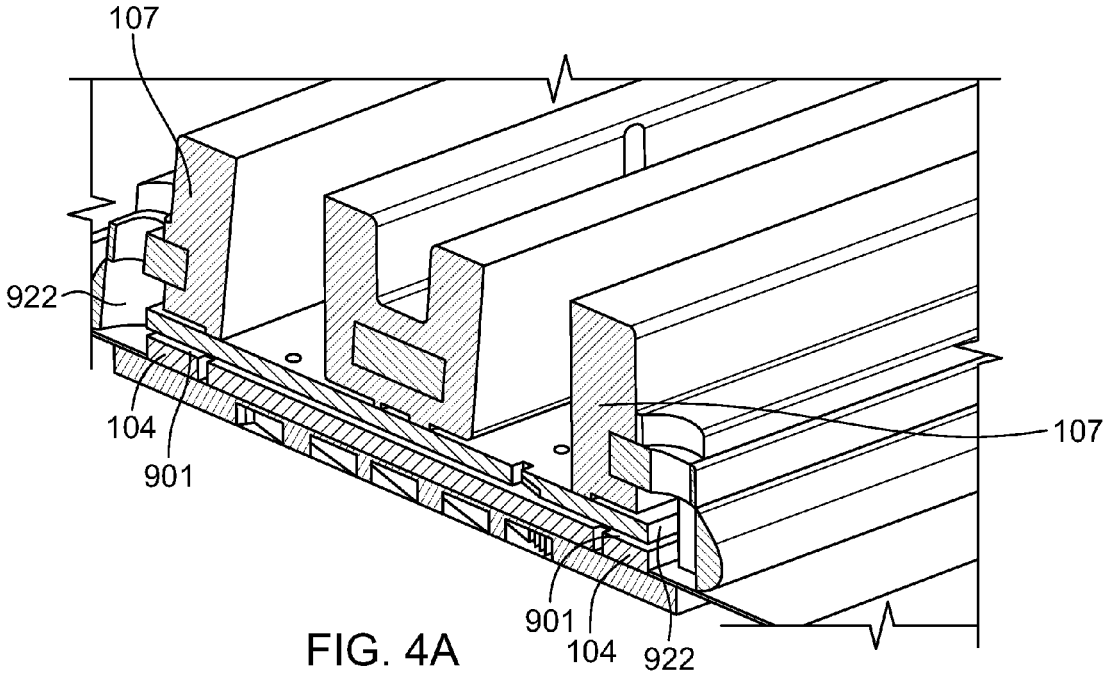
FIGS. 4A, 4B, and 4C are perspective views of a portion of an example fluid ejector having a passage in a housing.
Figure 4B:
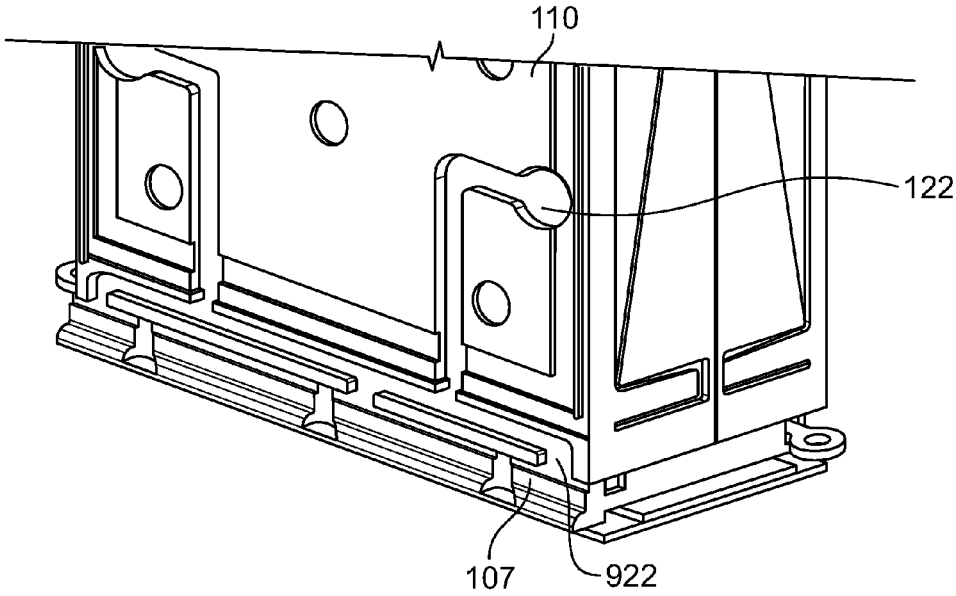
Figure 4C:
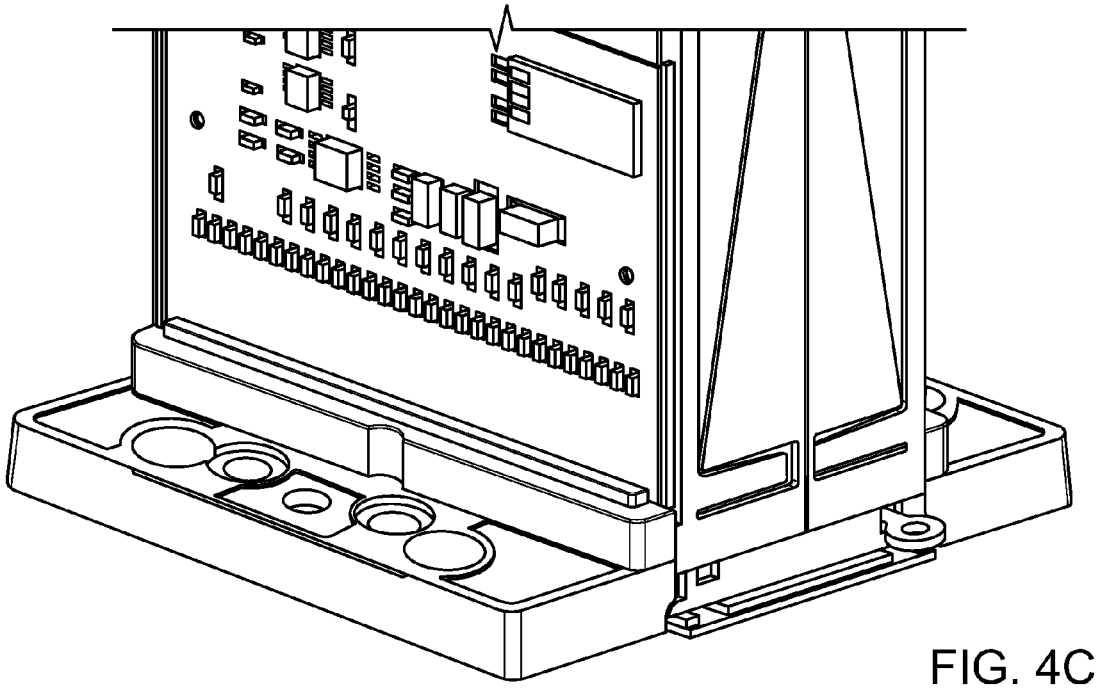

In some embodiments, shown in FIGS. 2A and 4A-5, a channel or passage 922 is formed through the die cap 107 and inner housing 110 to allow moisture to be removed from the integrated circuit elements 104 and/or actuators 401. As shown in FIG. 4A, the passage 922 can start at the cavity 901 above the integrated circuit elements 104 (which can be connected to the cavity 434, as discussed above) and can extend upwards through the die cap 107. The die cap 107 can be made of a stiffened plastic material, such as liquid crystal polymer ("LCP"), in order to stabilize the passage 922. Shown in FIG. 4B, the passage 922 can then extend through the inner housing 110 or form a groove on the surface of the inner housing 110. Further, as shown in FIG. 4C, the passage 922 can extend through the printed circuit board 155 and the flex circuit 201 (see FIG. 2A).

Figure 5:
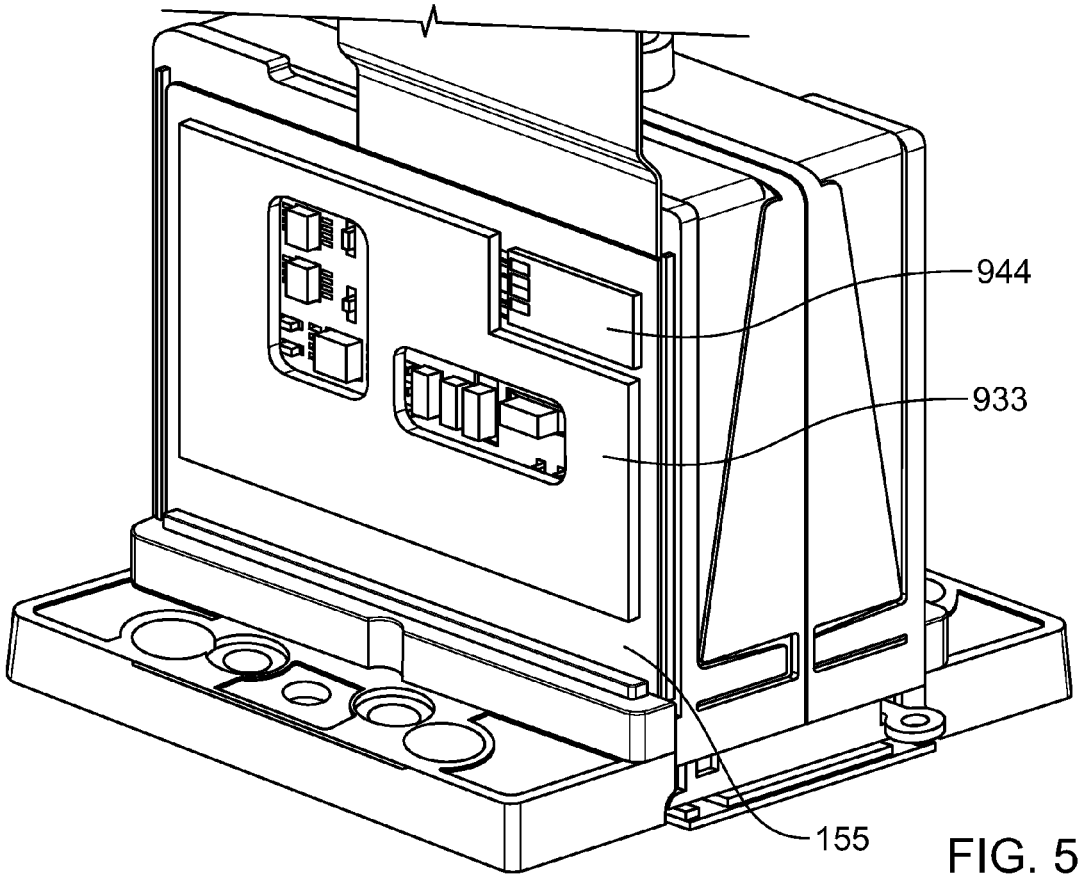
FIG. 5 is a perspective view of a portion of an example fluid ejector having an absorbent material attached to a flex circuit.

In some implementations, the passage 922 can end at a chamber or cavity 122 between the inner housing 110 and outer housing 142 (see FIG. 1). The cavity 122 can include an absorbent material, such as a desiccant. The desiccant can be, for example, silica gel, calcium sulfate, calcium chloride, montmorillonite clay, molecular sieves, zeolite, alumina, calcium bromide, lithium chloride, alkaline earth oxide, potassium carbonate, copper sulfate, zinc chloride, or zinc bromide. The desiccant can be mixed with another material, such as an adhesive, to form the absorbent, e.g. the absorbent can be STAYDRAY™ HiCap2000. Alternatively, an absorbent material such as paper, plastics (e.g. nylon6, nylon66, or cellulose acetate), organic materials (e.g. starch or polyimide such as Kapton® polyimide), or a combination of absorbent materials (e.g. laminate paper) can be placed in the cavity 122. The absorbent material 933 can be attached, for example, to the flex circuit 201 or the printed circuit board 155, as shown in FIG. 5. In other embodiments, the passage 922 can lead to the atmosphere, such as through a hole in cavity 122 (see FIG. 1).

In some implementations, the passage 922 can be connected to a pump, such as a vacuum pump, which can be activated by a humidity sensor, such as humidity sensor 944. The humidity sensor can be, for example, a bulk resistance-type humidity sensor that detects humidity based upon a change of a thin-film polymer due to vapor absorption. Thus, for example, if the humidity inside the cavity 901 and/or the cavity 434 rises above, e.g., 80-90%, the pump can be activated to remove moisture from the cavity 901. Such activation can avoid condensing humidity levels in the cavity 901 and/or the cavity 434.

During fluid droplet ejection, moisture from fluid being circulated through the ejector can intrude into the piezoelectric actuator or the integrated circuit elements, which can cause failure of the fluid ejector due to electrical shorting. By including an absorbent layer inside the cavity near the actuators or integrated circuit elements, the level of moisture in the cavity can be reduced, as absorbents, e.g. desiccants, can absorb up to 1,000 more times moisture than air.

Further, by having a passage in the inner housing that leads from a cavity containing the actuators and integrated circuit elements through the housing, the air volume surrounding the actuators and integrated circuit elements (e.g. from the cavities 901 and 434) can be increased up to 100 times. For example, the air volume can be increased 75 times, e.g. from 0.073 cc to 5.5 cc. Increasing the air volume can in turn increase the time that it takes for the air to become saturated, which can decrease the rate of moisture interfering with electrical components in the actuators or integrated circuit elements. By further adding an absorbent material, such as a desiccant, to a chamber at the end of the passage, the moisture can be further vented away from the electrical components. Such steps to avoid moisture can increase the lifetime of the fluid ejector.

The use of terminology such as "front," "back," "top," "bottom," "above," and "below" throughout the specification and claims is to illustrate relative positions or orientations of the components. The use of such terminology does not imply a particular orientation of the ejector relative to gravity.

Particular embodiments have been described. Other embodiments are within the scope of the following claims.

What is claimed is:

1. A fluid ejection apparatus comprising:

a substrate having a plurality of fluid passages for fluid flow and a plurality of nozzles fluidically connected to the fluid passages;

a housing component having a chamber, the chamber adjacent to the substrate;

a plurality of actuators positioned on top of the substrate to cause fluid in the plurality of fluid passages to be ejected from the plurality of nozzles;

a protective layer that covers and contacts at least a portion of the plurality of actuators inside the chamber, wherein the protective layer protects electrical components of the actuators from fluid or moisture in the ejection apparatus; and an absorbent layer inside the chamber, wherein the absorbent layer is more absorptive than the protective layer.

2. The fluid ejection apparatus of claim 1, wherein the actuators are piezoelectric actuators.

3. The fluid ejection apparatus of claim 1, wherein the actuators are entirely inside the chamber.

4. The fluid ejection apparatus of claim 1, further comprising a plurality of integrated circuit elements, the integrated circuit elements being inside the chamber, wherein the integrated circuit elements comprise transistors.

5. The fluid ejection apparatus of claim 1, wherein the housing component is an interposer.

6. The fluid ejection apparatus of claim 1, wherein the absorbent layer is attached to a bottom surface of the housing component.

7. The fluid ejection apparatus of claim 1, wherein the absorbent layer has a length and width that is approximately equal to a length and a width of the chamber.

8. The fluid ejection apparatus of claim 1, wherein the protective layer comprises photoresist.

9. The fluid ejection apparatus of claim 1, wherein the absorbent layer comprises a desiccant.

10. The fluid ejection apparatus of claim 9, wherein the desiccant is chosen from a group consisting of silica gel, calcium sulfate, calcium chloride, montmorillonite clay, molecular sieves, zeolite, alumina, calcium bromide, lithium chloride, alkaline earth oxide, potassium carbonate, copper sulfate, zinc chloride, and zinc bromide.

11. The fluid ejection apparatus of claim 1, wherein the absorbent layer is chosen from a group consisting of paper, plastic and organic material.

12. The fluid ejection apparatus of claim 11, wherein the plastic is chosen from a group consisting of nylon6, nylon66, and cellulose acetate.

13. The fluid ejection apparatus of claim 11, wherein the organic material is chosen from a group consisting of starch and polyimide.

14. The fluid ejection apparatus of claim 5, wherein the interposer includes at least one fluid supply passage having an opening on a bottom surface of the interposer and the plurality of fluid passages includes at least one inlet on a top surface of the substrate, wherein a portion of the bottom surface of the interposer around the opening abuts a portion of the top surface of the substrate around the opening to fluidically connect the fluid supply passage to the inlet, and wherein an interface between the interposer and the substrate around the fluid supply passage and the inlet is at least partially sealed.

15. The fluid ejection apparatus of claim 1, wherein the absorbent layer does not contact the actuators.

16. The fluid ejector of claim 1, wherein the plurality of actuators comprises a piezoelectric layer and a plurality of conductive traces inside the chamber extending from input pads to the piezoelectric layer, and wherein the protective layer covers and contacts at least a portion of the conductive traces inside the chamber.

17. The fluid ejector of claim 16, wherein the protective layer covers and contacts at least a portion of the piezoelectric layer inside the chamber.

18. The fluid ejector of claim 1, wherein the absorbent layer is located in a portion of the chamber adjacent the substrate.

19. The fluid ejection apparatus of claim 1, wherein the protective layer comprises a non-conductive material.

20. The fluid ejection apparatus of claim 1, wherein the protective layer comprises SU-8.

21. The fluid ejection apparatus of claim 1, wherein the protective layer protects electrical components of the actuators from fluid or moisture in ejection apparatus.

22. A fluid ejector, comprising:

a fluid ejection module comprising a substrate having a plurality of fluid paths and a plurality of actuators, each actuator configured to cause a fluid to be ejected from a nozzle of an associated fluid path;

a plurality of integrated circuit elements, wherein the integrated circuit elements are microchips other than the substrate, wherein the plurality of integrated circuit elements are mounted on the substrate of the fluid ejection module and positioned above the plurality of actuators, and wherein the plurality of integrated circuit elements comprises transistors; and a housing positioned to form a cavity above the fluid ejection module, the housing having a channel, wherein the channel connects the cavity with a chamber, the chamber comprising an absorbent material.

23. The fluid ejector of claim 22, wherein the plurality of integrated circuit elements are in the cavity.

24. The fluid ejector of claim 22, wherein the plurality of actuators are in the cavity.

25. The fluid ejector of claim 22, wherein the absorbent material comprises a desiccant.

26. The fluid ejector of claim 25, wherein the desiccant is chosen from a group consisting of silica gel, calcium sulfate, calcium chloride, montmorillonite clay, molecular sieves, zeolite, alumina, calcium bromide, lithium chloride, alkaline earth oxide, potassium carbonate, copper sulfate, zinc chloride, and zinc bromide.

27. The fluid ejector of claim 22, wherein the absorbent layer is chosen from a group consisting of paper, plastic and organic material.

28. The fluid ejector of claim 27, wherein the plastic is chosen from a group consisting of nylon6, nylon66, and cellulose acetate.

29. The fluid ejector of claim 27, wherein the organic material is chosen from a group consisting of starch and polyimide.

30. The fluid ejector of claim 22, further comprising a flexible circuit element in electrical communication with the fluid ejection module, wherein the chamber is attached to the flexible circuit element.

31. A fluid ejector, comprising:

a fluid ejection module comprising a substrate having a plurality of fluid paths and a plurality of actuators, each actuator configured to cause a fluid to be ejected from a nozzle of an associated fluid path;

a plurality of integrated circuit elements, wherein the plurality of integrated circuit elements are mounted on the fluid ejection module; and a housing positioned to form a cavity above the fluid ejection module, the housing having a channel, wherein the channel connects the cavity with a chamber, the chamber comprising an absorbent material, wherein the channel is further connected from the chamber to atmosphere.

* * * * *

UNITED STATES PATENT AND TRADEMARK OFFICE

CERTIFICATE OF CORRECTION

PATENT NO. : 8,147,040 B2
APPLICATION NO. : 12/395583
DATED : April 3, 2012
INVENTOR(S) : Christoph Menzel It is certified that error appears in the above-identified patent and that said Letters Patent is hereby corrected as shown below:

In Claim 16, at Column 8, line 13, delete "ejector" and insert --ejection apparatus--.

In Claim 17, at Column 8, line 19, delete "ejector" and insert --ejection apparatus--.

In Claim 18, at Column 8, line 22, delete "ejector" and insert --ejection apparatus--.

Signed and Sealed this
Twenty-sixth Day of June, 2012

David J. Kappos

David J. Kappos
*Director of the United States Patent and Trademark Office*